US005950060A

United States Patent [19]

Isogai

[11] Patent Number: 5,950,060

[45] Date of Patent: Sep. 7, 1999

[54] FIXING DEVICE

[75] Inventor: Mitsuru Isogai, Aichi-Ken, Japan

[73] Assignee: Minolta Co., Ltd., Osaka, Japan

[21] Appl. No.: 09/226,159

[22] Filed: Jan. 7, 1999

[30] Foreign Application Priority Data

Jan. 13, 1998 [JP] Japan ..... 10-005180

[51] Int. Cl.[6] ..... G03G 15/20

[52] U.S. Cl. ..... 399/324; 399/325; 399/326; 399/327; 399/328

[58] Field of Search ..... 399/324, 325, 399/326, 327, 328; 219/216; 432/60

[56] References Cited

U.S. PATENT DOCUMENTS 5,724,638 9/1996 Isogai et al. ..... 399/333
5,732,316 3/1998 Yamasaki et al. ..... 399/321

FOREIGN PATENT DOCUMENTS 02230277 9/1990 Japan .
05119659 5/1993 Japan .

*Primary Examiner*—Richard Moses
*Assistant Examiner*—Shival Virmani
*Attorney, Agent, or Firm*—McDermott, Will & Emery

[57] ABSTRACT

A fixing device of the belt system is provided in which slippage of a heating belt is prevented from occurring so that a recording member is stably transported, and the inner face of an end portion of the heating belt is prevented from being damaged. In a fixing device, an endless heating belt 34 is supported by a driving roller 31 and a heating roller 33, a pressure roller is pressingly contacted with an outer peripheral portion of the belt so as to form a nip portion, and an unfixed image on a recording medium transported to the nip portion is fixed to the recording medium. The axial lengths L2 of the driving roller 31 and the heating roller 33 are set to be shorter than the width L1 of the belt 34, and the axial length L3 of an oil applying roller 51 which abuts against the outer peripheral portion of the belt 34 to apply oil thereto is set to be shorter than the axial lengths L2 of the driving roller 31 and the heating roller 33.

11 Claims, 3 Drawing Sheets

FIXING DEVICE

This application is based on application No. Hei 10-005180 filed in Japan, the content of which is hereby incorporated by reference.

BACKGROUND OF THE INVENTION

1. Field of the Invention

The present invention relates to a fixing device which is to be disposed in an image forming apparatus such as an electrophotographic printer or a copier.

2. Description of the Related Art

An image forming apparatus such as a printer or a copier using the electrophotographic process is provided with a fixing device which fixes an unfixed toner image held on a recording member such as a recording sheet or an OHP sheet. As the fixing system, conventionally, a so-called heating roller system is widely used. A fixing device of the heating roller system includes a heating roller having a heat source, and a pressure roller which is pressingly contacted with the heating roller. A recording member holding an unfixed toner image is passed through a nip portion where these rollers are contacted with each other, so that heat and pressure are applied to the recording member. As a result, the toner image is fixed to the recording member.

In such an electrophotographic image forming apparatus, particularly in an image forming apparatus which produces a full color image, a large amount of toner adheres to a recording member. Therefore, it is preferable to configure a fixing device of such an image forming apparatus, so that the length (nip width) of the nip portion in the transport direction is made as large as possible and an unfixed toner image formed on a recording member is fixed to the recording member by heating the toner at a temperature which is as low as possible, and for a long time period.

In the heating roller system of the prior art, however, the nip width depends on the outer diameter of a roller and the thickness of a heat-resistant elastic layer which is formed in the surface layer of the roller. In order to ensure a large nip width, therefore, it is required to increase the outer diameter of a heating roller or to thicken the surface layer. As a result, when a large nip width is ensured in a fixing device for a full color image and of the heating roller system, there arise problems in that the size of the device is increased, and that the reduced heat conduction causes the printing speed to be lowered.

As a countermeasure against the above, a fixing device of a so-called belt system has been proposed which includes a heating belt having a heat-resistant elastic surface layer, and in which the heating belt is pressingly contacted with a pressure roller, thereby forming a nip portion. In a fixing device of the belt system, a large nip width can be easily ensured. As compared with a device of the heating roller system, therefore, a fixing device of the belt system has advantages that the size of the device can be reduced, and that the printing speed can be increased.

A fixing device of the pressuring and heating fixing system, such as the above-described prior art fixing devices of the heating roller system or the belt system has the configuration in which, among the faces of a recording member, the face holding a toner image is directly contacted with the surface of a rotation member such as the heating roller or the heating belt. Therefore, part of an unfixed toner image on the recording member is easily transferred to the rotation member. As a result, such a firing device has a disadvantage that a so-called offset phenomenon in which toner fused to the rotation member is reversely transferred to the rear end of the recording member to soil it, or to a next-transferred recording member to soil it easily occurs. In order to prevent the offset phenomenon from occuring, therefore, a fixing device of the pressuring and heating fixing system is provided with a release agent applying mechanism which applies a release agent to a rotation member so as to improve the release properties between the rotation member and toner.

In the case of a fixing device of the heating roller system, the axial length of the contact face of the release agent applying mechanism which is to be contacted with a heating roller exerts only an effect on the maximum image formation width in the view point that the release agent is to be ensured with respect to a toner image. Even when the axial length of the contact face is somewhat prolonged, or even when a large amount of the release agent is applied, there arises no serious technical problem. In other words, in a fixing device of the heating roller system, a recording member is transported by a heating roller itself, and hence a problem such as a failure of transportation of a recording member is not produced unless a release agent is supplied in a very excessive manner. Furthermore, a functional problem due to the movement of the release agent to the inner side via an end face of the heating roller does not occur. There may arise a case where the release agent is moved to an end face of the heating roller and then along the core. It is considered that such a case can be solved by another technique.

By contrast, the following problems are produced in the above-described prior art fixing device of the belt system. Namely, the release agent which is applied to the outer face of the heating belt by the release agent applying mechanism is moved to the inner face of the heating belt, thereby causing a problem in that slippage occurs between the heating belt and a roller around which the heating belt is wound. This slippage impedes the stable transportation of a recording member and lowers the quality of a fixed image. In a fixing device for a full color image, particularly, a release agent must be applied in an amount which is larger than that required in a fixing device for a monochromatic image, because toners of plural colors are superimposed to one another and a large amount of toner adheres to a recording member. Therefore, the above-mentioned problem becomes remarkable in such a fixing device.

In a fixing device of the belt system, the belt may slightly meander in the width direction (the axial direction of the roller). In such a case, when a release agent applying roller of the release agent applying mechanism is pressingly contacted with the heating belt, there arises another problem in that the inner face of an end portion in the width direction of the heating belt is damaged by the outer face of an end portion of a roller around which the heating belt is wound.

SUMMARY OF THE INVENTION

The invention has been conducted in view of the above-discussed problems of the prior art. It is an object of the invention to provide a fixing device of the belt system in which slippage of a heating belt is prevented from occurring so that a recording member is stably transported, and the inner face of an end portion of the heating belt is prevented from being damaged.

BRIEF DESCRIPTION OF THE DRAWINGS

These and other objects and features of this invention will become clear from the following description, taken in conjunction with the preferred embodiments with reference to the accompanied drawings in which.

DETAILED DESCRIPTION OF THE PREFERRED EMBODIMENTS

Hereinafter, an embodiment of the invention will be described with reference to the accompanying drawings.

<Configuration of the Whole of a Printer of an Embodiment>

Figure 1:
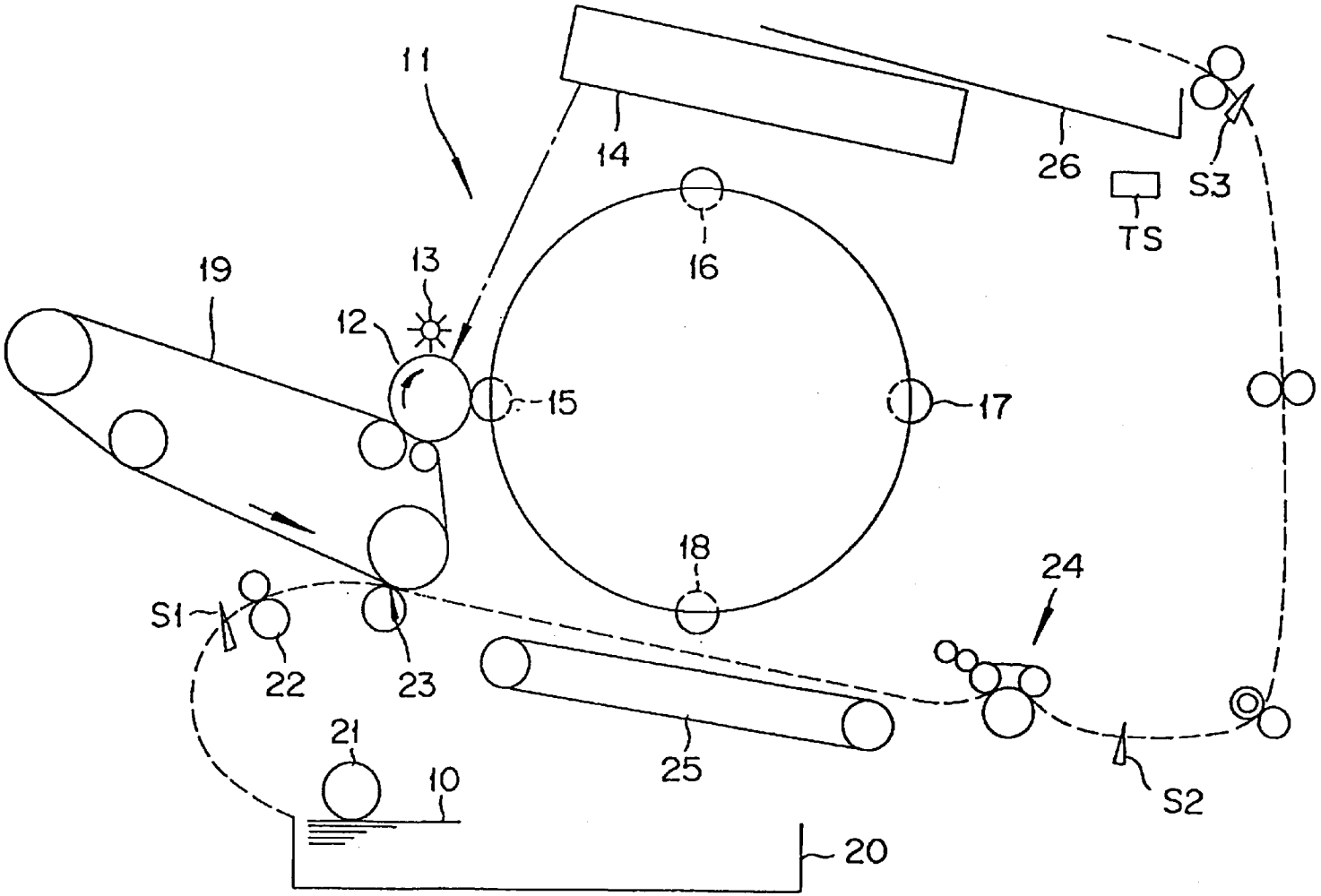
FIG. 1 is a schematic diagram showing the configuration of a full color printer of the electrophotographic system into which the fixing device of the invention is incorporated.

FIG. 1 is a schematic diagram showing the configuration of a full color printer of the electrophotographic system into which the fixing device of the invention is incorporated.

The printer 11 shown in FIG. 1 comprises a photosensitive drum 12 serving as an image carrier, and a laser beam generator 14. Around the photosensitive drum 12 which is rotated in the direction of the arrow, arranged are: a charging device 13 which charges the outer peripheral face of the photosensitive drum 12; a developing device having first to fourth developers 15, 16, 17, and 18; a transfer belt 19; a cleaning device (not shown) which removes away residual toner on the photosensitive drum 12; and a printer temperature detection sensor TS which detects the temperature in the printer 11. The laser beam generator 14 drives and modulates a semiconductor laser device in accordance with the level of an image signal supplied from a computer (not shown) or the like. A laser beam impinges on the photosensitive drum 12 between the charging device 13 and the developer, via a polygon mirror, an f-(lens, and a reflecting mirror which are not shown. An electrostatic image which is formed on the photosensitive drum 12 by the laser beam irradiation is developed as a yellow toner image by the first developer 15. The yellow toner image is held on the transfer belt 19 which is rotatingly moved in the direction of the arrow. An electrostatic image which is next formed on the photosensitive drum 12 is developed as a magenta toner image by the second developer 16. The magenta toner image is superimposed on the yellow toner image on the transfer belt 19. Similarly, an electrostatic image which is next formed on the photosensitive drum 12 is developed as a cyan toner image by the third developer 17, and the cyan toner image is superimposed on the toner images on the transfer belt 19, thereby forming a full color toner image. The fourth developer 18 houses black toner. When a monochromatic print is designated, an electrostatic image on the photosensitive drum 12 is developed by the fourth developer 18.

A sheet supply cassette 20 which is detachably attached to the printer main unit houses plural recording members 10 such as recording sheets or OHP sheets in a stacked manner. The recording members 10 are separately supplied by a sheet supply roller 21. Each of the recording members is transported toward a transfer region 23 by a timing roller 22 with being synchronized with a toner image. In the transfer region 23, the full color toner image on the transfer belt 19 is transferred to the recording member 10. The recording member 10 which has undergone the transfer process is separated from the transfer belt 19, and then transported toward a fixing device 24 by a transport belt 25. The unfixed toner which has been transferred to the recording member 10 is fused and fixed in the fixing device 24. The recording member 10 to which the toner is fixed is discharged onto a sheet discharge tray 26. The fixing device 24 of the embodiment is of the belt system. The configuration of the fixing device will be described later in detail.

When the transfer to the recording member 10 is ended, residual toner on the photosensitive drum 12 is removed away by the cleaning device and residual charges on the drum are discharged by an eraser. Thereafter, the photosensitive drum 12 is again charged by the charging device 13, and then subjected to the electrostatic image formation by means of a laser beam. The electrostatic images are developed by the developers 15 to 18.

Plural sensors S1, S2, and S3 for detecting the recording member 10 are arranged along the recording member transport path. The control timings of components in the printer are provided on the basis of signals from the sensors S1, S2, and S3 and indicative of detection of the front edge and/or the rear edge of the recording member 10.

<Configuration of the whole of the fixing device>

Figure 2:
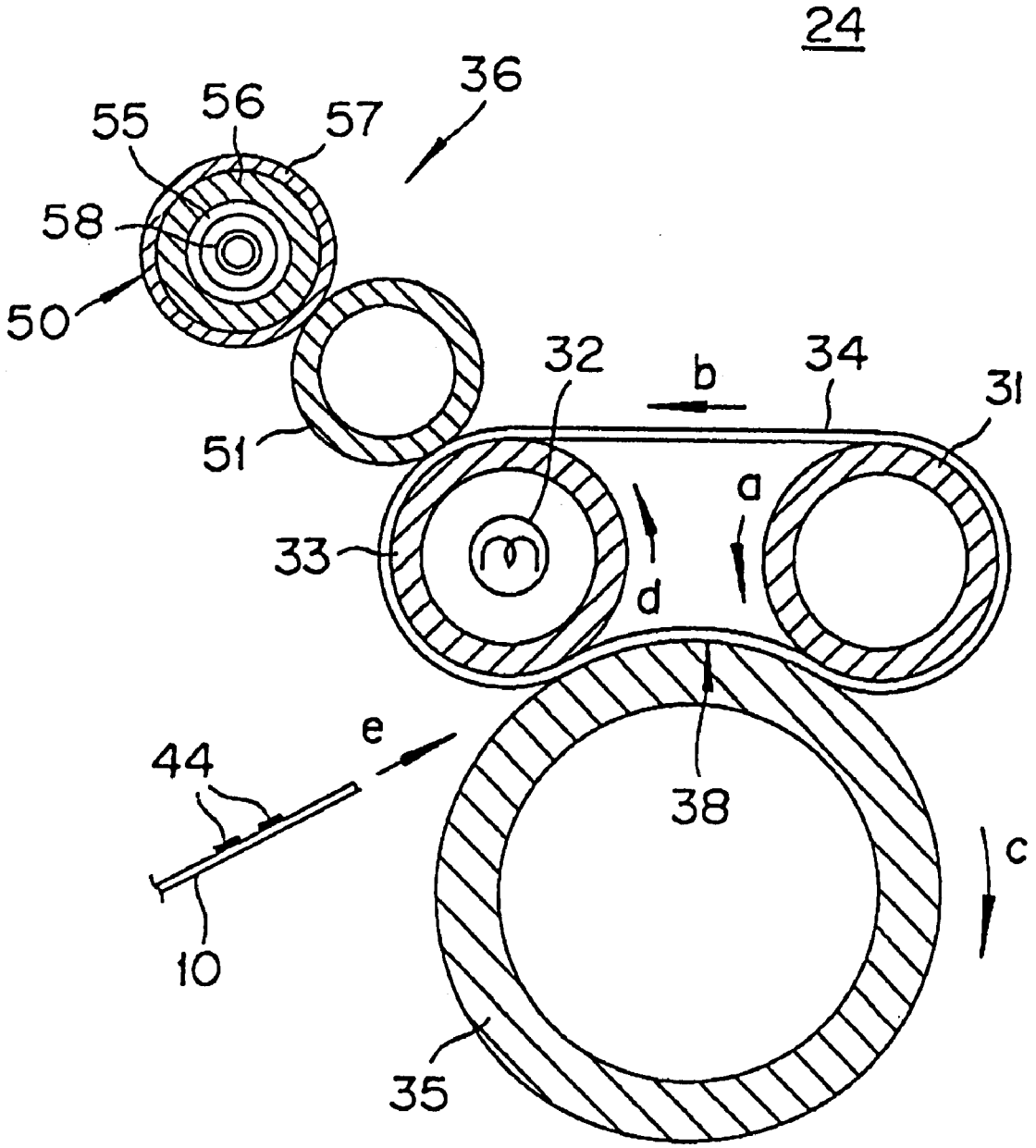
FIG. 2 is a section view showing the fixing device of the belt system and shown in FIG. 1.

Fig. 2 is a section view showing the fixing device of the belt system and shown in FIG. 1.

The fixing device 24 comprises: a driving roller 31 which can be rotated in the direction of the arrow a; a heating roller 33 in which a tungsten-halogen heating lamp 32 serving as a heat source is incorporated; and a heating belt 34 which runs between the driving roller 31 and the heating roller 33 with being wound around the rollers. The fixing device 24 further comprises: a pressure roller 35 serving as the pressure member which is pressingly contacted with the driving roller 31 via the heating belt 34; and an oil applying unit 36 serving as the release agent applying mechanism which applies a release agent for preventing offset to the outer peripheral face of the heating belt 34. In at least one of the paired rollers 31 and 33 around which the heating belt 34 is wound, a lateral movement restricting member (not shown) which prevents the running heating belt 34 from skewing or meandering is attached to the ends in the axial direction of the roller, so that the running of the heating belt 34 is stabilized. The heating belt 34 corresponds to a rotation member for pressingly and heatingly fixing toner held on the recording member 10. Silicone oil is used as the release agent.

The heating belt 34 is a thin belt which is preferably seamless. The belt is formed as an endless belt having a base member which is made of carbon steel, stainless steel, nickel, heat-resistant resin, or the like. The surface of the belt base member is coated with silicone rubber which has an affinity for silicone oil, so as to form a heat-resistant release layer which has excellent release properties with respect to toner and heat resistance. The belt base member has a thickness of about 40 $\mu$m, and the rubber coating has a thickness of about 20 $\mu$m. Alternatively, fluorine resin such as polytetrafluoroethylene resin may be used as the heat-resistant release layer of the heating belt 34.

In the driving roller 31, a driving gear which is not shown is secured to one end of the roller. The driving roller is rotated in the direction of the arrow a by a driving source such as a motor (not shown) which is coupled to the gear. The driving roller 31 is contacted with the rear face of the heating belt 34 so as to move the heating belt 34 in the direction of the arrow b. In this way, among the rollers around which the heating belt 34 is wound, the roller on the sheet discharge side is driven, thereby preventing the heating belt 34 from being slackened in the nip portion.

In order to surely move the heating belt 34, the outer peripheral face of the driving roller 31 is coated with a material of a large coefficient of friction (for example, silicone rubber), so as to prevent slippage between the roller and the heating belt 34 from occurring.

The heating roller 33 is formed by a hollow metal roller. The tungsten-halogen heating lamp 32 is disposed on the center axis of the roller. Alternatively, a resistance heating member or an electromagnetic induction heating device may be used as the heat source. From the view point of efficiently supplying heat to the heating belt 34, it is preferable to form the heating roller 33 by a material of high thermal conductivity, such as aluminum or copper.

The pressure roller 35 is formed by a roller in which the outer periphery of a metal pipe is coated with silicone rubber or polytetrafluoroethylene resin. The pressure roller is urged by the spring force of a spring (not shown) so as to be pressingly contacted with the driving roller 31 and the heating roller 33 via the heating belt 34. A tungsten-halogen heating lamp may be disposed also on the center axis of the pressure roller 35. When the heating belt 34 is moved in the direction of the arrow b in accordance with the rotation of the driving roller 31, the pressure roller 35 is followingly rotated in the direction of the arrow c by friction between the roller and the heating belt 34. The pressure roller 35 may be configured so as to be rotated at a speed coincident with the running speed of the heating belt 34. In this case, for example, the shaft of the pressure roller 35 may be coupled to driving means such as a motor via a one-way dutch (these components are not shown). When the pressure roller 35 is rotated at a predetermined speed in a direction along which the roller is allowed to freely rotate, the pressure roller 35 can be rotated in the case of a low printing speed, and followingly rotated in the case of a high printing speed where the diameter of the roller tends to be increased by heat. According to this configuration, even when the pressure roller 35 is driven to rotate, it is possible to prevent slippage between the pressure roller 35 and the heating belt 34 from occurring.

A first temperature sensor which detects the temperature of the heating roller 33 is disposed at an inner position with respect to the heating belt 34, and a second temperature sensor which detects the temperature of the pressure roller 35 is disposed adjacent to the pressure roller 35 (both the sensors are not shown). Each of the temperature sensors is configured by, for example, a thermistor, and contacted with the surface of the corresponding one of the rollers 33 and 35 so as to detect the surface temperature of the roller.

In the printer 11 of the embodiment, the surface temperature of the pressure roller 35 which is not provided with a heat source is detected by the second temperature sensor, and, on the basis of the detected surface temperature of the pressure roller 35, the control temperature of the tungsten-halogen heating lamp 32 is determined and the timing of starting the printing is controlled. In order to adjust the temperature of the tungsten-halogen heating lamp 32 to the determined control temperature, the energization of the tungsten-halogen heating lamp 32 is turned on and off while the surface temperature of the heating roller 33 is detected by the first temperature sensor.

A thermostat may be disposed as a safety mechanism against a case where the temperature of the tungsten-halogen heating lamp 32 is abnormally raised, so that the power supply to the tungsten-halogen heating lamp 32 is shut off when an abnormally high temperature is detected.

The oil applying unit 36 is disposed above the heating belt 34, and has: an oil supplying roller 50 which retains oil to be applied to the heating belt 34; and an oil applying roller 51 which abuts against the surface of the oil supplying roller 50 so as to apply the oil supplied from the oil supplying roller 50, to the outer peripheral face of the heating belt 34. The rollers 50 and 51 are rotatably supported by a holder which is not shown. A deaning roller which is not shown is rotatably disposed so as to abut against the surface of the oil applying roller 51 to remove away paper dust and toner adhering to the oil applying roller 51.

The oil applying roller 51 is disposed so that its contact face is opposed to the heating roller 33 via the above-mentioned belt. According to this configuration, the oil applying roller 51 can be sufficiently pressingly contacted with the heating belt 34 with a predetermined pressing force. Therefore, the following rotation of the oil applying roller 51 is smoothly conducted without causing slippage, so that the release agent can be applied stably and uniformly. Consequently, there does not arise a situation in which the amount of application to the heating belt 34 is partly increased and the release agent enters the inside of the heating belt 34. Alternatively, the oil applying roller 51 may be disposed in a middle point of a region where the heating belt 34 is moved from the driving roller 31 to the heating roller 33, so as to be pressingly contacted with the heating belt 34 while applying a suitable tension.

The oil supplying roller 50 has a multilayer structure comprising: an oil retention layer 56 serving as the release agent impregnated member which is disposed on the surface of a core 55 and which retains oil; and a surface layer 57 which is disposed on the side of the surface of the oil retention layer 56. For example, an aluminum roller having an outer diameter of 10 mm is used as the core 55, the oil retention layer 56 is formed by winding Japanese paper on the core 55 so to have a thickness of 5 mm, and the surface layer 57 is formed by winding an aromatic aramid fiber on the surface of the oil retention layer 56 so to have a thickness of 0.2 mm.

A supply nozzle 58 is disposed on the center axis of the core 55 in a nonrotatable manner, so as to supply a required amount of oil. Plural through holes which are not shown are formed in the core 55 at substantially regular intervals. The inner and outer faces of the core 55 are communicated with each other through the through holes. The oil which is supplied from the supply nozzle 58 to the inner face of the core 55 passes through the through holes of the core 55 to reach the outer face of the core 55, so that the oil retention layer 5 is impregnated with the oil. Therefore, stable and uniform oil application is enabled for a long term. In this way, the amount of oil applied to the belt is stably uniform. Consequently, the stabilized transportation of a recording member can be further ensured.

In the oil applying unit 36, oil which is to be applied to the surface of the heating belt 34 is supplied from the oil supplying roller 50 via the oil applying roller 51. According to this configuration, the function of pressingly contacting with the surface of the heating belt 34 to apply oil, and that of retaining oil and adjusting the application amount of oil are conducted by the oil applying roller 51 and the oil supplying roller 50, respectively. As a result, the application amount of the release agent can be made further stable and uniform. Since the oil applying roller is interposed between the oil supplying roller 50 and the heating belt 34, a fear that the heat of the heating belt 34 is directly transmitted to the oil supplying roller 50 and the oil inside the roller is heated to evaporate is lessened.

The oil applying roller 51 is formed by coating the core with silicone rubber which has an affinity for silicone oil. In order to stickingly attract dirt from the heating belt 34, the roughness of the surface of the oil applying roller 51 is made larger than that of the surface of the heating belt 34. In order to stickingly attract dirt from the oil applying roller 51, release properties of the surface of the above-mentioned cleaning roller which is not shown are set to be lower than those of the surface of the oil applying roller 51.

The oil applying unit 36 is detachably attached to a frame of the fixing device 24. When oil retained in the oil supplying roller 50 is totally consumed, the consumed oil applying unit 36 is detached from the frame, and a new oil applying unit 36 is attached to the frame. In place of the cleaning roller, a cleaning pad may be contacted with the surface of the oil applying roller 51, or the oil supplying roller 50 may be directly pressingly contacted with the heating belt 34.

Next, the operation of the fixing device 24 will be roughly described.

When the motor is operated, the driving roller 31 is rotated in the direction of the arrow a, and the heating belt 34 runs in the direction of the arrow b. As the heating belt 34 runs, the heating roller 33 is followingly rotated in the direction of the arrow d, and the pressure roller 35 is followingly rotated in the direction of the arrow c. The running heating belt 34 is applied with oil by the oil applying roller 51, and, in the area where the belt is contacted with the heating roller 33, heated to a predetermined temperature by heat generated by the tungsten-halogen heating lamp 32. Thereafter, the heating belt proceeds to a nip portion 38 between the heating belt and the pressure roller 35.

On the other hand, the recording member 10 holding unfixed toner 44 on the face which is to be contacted with the heating belt 34 is transported in the direction of the arrow e toward the nip portion 38 with being guided by a guide plate (not shown).

When the recording member 10 is further transported to enter the nip portion 38, the recording member 10 is transported with being pressingly held in the nip portion 38 while the recording member is sufficiently heated by the heat of the heating belt 34 and applied with a pressing force exerted by the pressure roller 35 and the rollers 31 and 33. As a result, the unfixed toner 44 on the recording member 10 is sufficiently heated to fuse, and further pressurized to be fixed to the recording member 10. The movement of toner to the heating belt 34, i.e., offset is suppressed by the oil applied to the surface of the heating belt 34.

The recording member 10 which has passed through the nip portion 38 is spontaneously separated from the heating belt 34, and then transported toward the sheet discharge tray 26 (see FIG. 1). The heating belt 34 from which heat has been absorbed as a result of contact with the recording member 10 is replenished with heat from the tungsten-halogen heating lamp 32 under a predetermined temperature control.

Since dirt due to paper dust, toner, and the like on the heating belt 34 is stickingly attracted from the oil applying roller 51 abutting against the heating belt 34 to the cleaning roller (not shown), dirt adhering to the oil supplying roller 50 is reduced. According to this configuration, oil is supplied more uniformly and stably from the oil supplying roller 50 to the oil applying roller 51, with the result that oil can be applied uniformly and stably from the oil applying roller 51 to the heating belt 34. Therefore, also the cleaning of the heating belt 34 can be conducted while surely preventing offset from occurring, and hence a fixed image of a high quality can be obtained.

<Configuration relating to the dimension in the axial direction of the fixing device>

Figure 3:
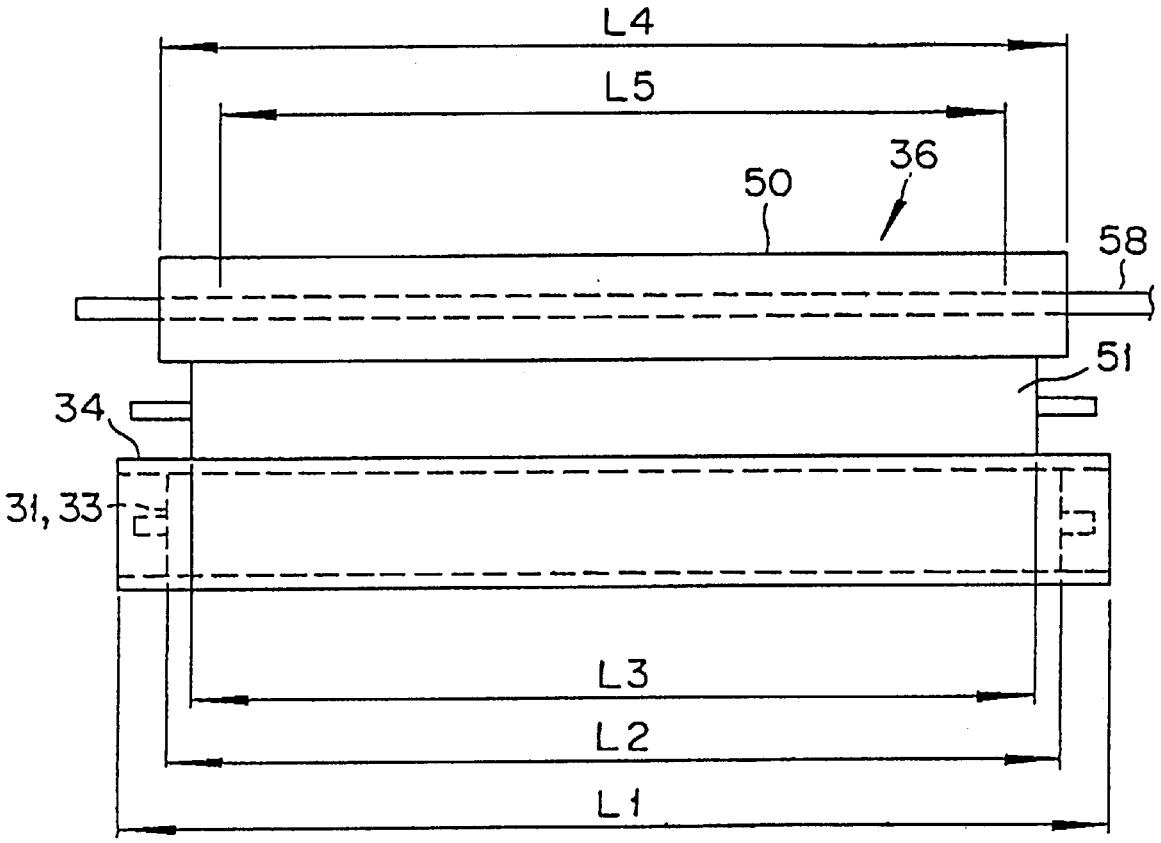
FIG. 3 is a view of the fixing device shown in FIG. 2 as seen from the upstream side in the direction of transporting a recording member.

FIG. 3 is a view of the fixing device shown in FIG. 2 as seen from the upstream side in the direction of transporting a recording member. In FIG. 3, the pressure roller 35 is not shown.

As shown in FIG. 3, the driving roller 31 and the heating roller 33 around which the heating belt 34 is wound have an outer peripheral face serving as a contact face and having an axial length L2 which is shorter than the width L1 of the heating belt 34 by, for example, about 5 mm. Furthermore, the oil applying roller 51 of the oil applying unit 36 has an outer peripheral face serving as a contact face and having an axial length L3 which is shorter than the axial length L2 of the outer peripheral faces of the driving roller 31 and the heating roller 33 by, for example, about 2 mm. In the case where the rollers have a uniform diameter over the entire length in the axial direction, the dimensions L2 and L3 are equal to the axial lengths of the rollers, respectively. In the case where a step is formed in an end portion, the dimensions indicate only the lengths of the contact faces.

As described above, in the embodiment, the end portions in the width direction of the heating belt 34 are outward separated from the end portions of the oil applying roller 51 and those of the driving roller 31 by a predetermined distance. Therefore, a situation where the oil which is applied from the oil applying roller 51 of the oil applying unit 36 to the surface of the heating belt 34 overrides the heating belt 34 to enter the inside of the heating belt 34 is prevented from occurring. In other words, the end portions of the heating belt 34 function as partition walls, so that the movement of oil from the oil applying roller 51 to the driving roller 31 inside the heating belt 34 can be suppressed.

Therefore, a fault condition that oil enters between the inner face of the heating belt 34 and the outer peripheral face of the driving roller 31 and slippage between the heating belt 34 and the driving roller 31 occurs can be prevented from arising. As a result, stabilized transportation of a recording member can be ensured, and the quality of a fixed image can be improved. Particularly in a full color printer in which toners of plural colors are superimposed to one another, since a large amount of a release agent must be applied, it is preferable to use the fixing device.

As described above, the axial length L2 of the driving roller 31 around which the heating belt 34 is wound at a given tension is shorter than the width L1 of the heating belt 34. Therefore, the outer faces of the end portions of the driving roller 31 impose a small load on the inner faces of the end portions of the heating belt 34. At the same time, in the embodiment, the configuration in which the axial length L3 of the oil applying roller 51 is shorter than the axial lengths L2 of the driving roller 31 and the heating roller 33 performs a function of relaxing the load which is imposed on the inner faces of the end portions of the heating belt 34 by the outer faces of the end portions of the driving roller 31, so as to reduce the load to a minimum level. According to this configuration, it is possible to prevent damages such as breakage or bend from occurring on the inner faces of the end portions in the width direction of the heating belt 34.

The oil supplying roller 50 has an outer peripheral face serving as a contact face and having an axial length L4 which is longer than the axial length L3 of the oil applying roller 51. This configuration is employed because the vicinity of each of the ends of the oil supplying roller 50 tends to hold a larger amount of oil and, from the view point of uniform application of oil, oil supply from these portions is to avoided. In the embodiment, the distribution range L5 of the through holes which are not shown and which are formed in the core 55 at substantially regular intervals is set to be shorter by a given length than the maximum width of a recording member which can be used in the printer 11. According to this configuration, the range through which recording members of a small size frequently pass can be impregnated with a larger amount of oil.

The invention is not restricted to the embodiment described above, and one of ordinary skill in the art may variously modify the invention without departing from the technical scope of the invention.

For example, an oil applying member is not restricted to the roller. An blade may be used as an oil applying member.

As described above, the configuration of the embodiment can attain the following effects.

A situation where the release agent which is applied from the release agent applying mechanism to the surface of the belt overrides the belt to enter the inside of the belt can be prevented from occung. In other words, the end portions of the belt function as partition walls, so that the movement of the release agent to a roller inside the belt can be suppressed. Therefore, a fault condition that the release agent enters between the inner face of the belt and the outer peripheral face of the roller and slippage between the belt and the roller occurs can be prevented from arising. Furthermore, the axial length of the contact face of the release agent applying mechanism is made shorter than the axial length of the roller, and hence the load which is imposed on the inner faces of the end portions of the belt by the outer faces of the end portions of the roller can be relaxed so as to reduce the load to a minimum level.

Obviously, many modifications and variation of the present invention are possible in light of the above teachings. It is therefore to be understood that within the scope of the appended claims, the invention may be practiced other than as specifically described.

What is claimed is:

1. A fixing device which fixes an unfixed image on a recording medium to the recording medium, and which comprises:

a heating unit which has a belt supported by plural rollers of which lengths of the plural rollers in axial direction is shorter than a width of the belt;

a pressure member which is pressingly contacted with an outer peripheral portion of the belt and thereby forms a nip portion; and a release agent applying mechanism which includes a contact member which has a contact face, and a dimension of the contact face in a width direction of the belt is shorter than the lengths of the plural rollers, and applies a release agent to the belt by abutting the contact face against an outer peripheral portion of the belt.

2. A fixing device as claimed in claim 1, wherein the release agent applying mechanism further comprises a core in which plural through holes through which inner and outer faces of the core are communicated with each other are formed, and a release agent impregnated member which covers an outer periphery of the core and which is impregnated with a release agent through the through holes.

3. A fixing device as claimed in claim 2, wherein the release agent applying mechanism further comprises a roller which applies the release agent supplied from the release agent impregnated member to the belt.

4. A fixing device as claimed in claim 2, wherein the contact member is disposed between the release agent impregnated member and the belt.

5. A fixing device as claimed in claim 1, wherein the contact member is a roller.

6. A fixing device as claimed in claim 1, wherein the contact member is a blade.

7. A fixing device as claimed in claim 1, further comprises a release agent keep member.

8. A fixing device as claimed in claim 7, wherein the contact member is disposed between the release agent keep member and the belt.

9. A fixing device comprising:

a belt which fixes an unfixed image to a recording medium and has a certain length width;

plural rollers which support the belt and have a width shorter than that of the belt; and a contact member which has a contact portion being contact with the belt and applies a release agent to the belt, wherein the contact portion has a width shorter than that of the rollers.

10. A fixing device as claimed in claim 9, wherein the contact member is a roller.

11. A fixing device as claimed in claim 9, wherein the contact member is a blade.

* * * * *